United States Patent [19]

Chen

[11] 4,129,894

[45] Dec. 12, 1978

[54] LAMINATED CURRENT SURGE PROTECTOR

[75] Inventor: Keith A. Chen, Milwaukee, Wis.

[73] Assignee: Wisconsin Gas Company, Milwaukee, Wis.

[21] Appl. No.: 813,536

[22] Filed: Jul. 7, 1977

[51] Int. Cl.[2] ..... H01T 1/00

[52] U.S. Cl. ..... 361/117; 313/325; 313/355; 361/124; 361/129; 361/130

[58] Field of Search ..... 361/117, 119, 124, 125, 361/129, 130; 313/325, 355

[56] References Cited

U.S. PATENT DOCUMENTS

| | | | |
|---|---|---|---|
| 2,761,979 | 9/1956 | Wilson | 361/117 X |
| 2,795,725 | 6/1957 | Strab | 313/325 |
| 2,959,692 | 11/1960 | Marx | 361/117 X |
| 3,416,027 | 12/1968 | Amason et al. | 361/117 X |
| 3,492,534 | 1/1970 | Szeremy et al. | 313/325 X |

*Primary Examiner*—Harry E. Moose, Jr.
*Attorney, Agent, or Firm*—Andrus, Sceales, Starke & Sawall

[57] ABSTRACT

A laminated current surge protector comprising a flexible, conformable arrestor having a metal conductor encapsulated between a wear resistant tape adhered to the outer surface of the conductor and a dielectric tape adhered to the inner surface of the conductor. The arrestor is adhered to metal members by a bonding agent and extends across the joint between the members which includes an electrical insulating medium separating the members. The dielectric tape has a plurality of apertures therein exposing the encapsulated conductor to the metal members to provide a gap through which excessive surges of current in the metal members can pass through the conductor from one metal member to the other and thereby by-pass the joint and prevent injury thereto.

6 Claims, 7 Drawing Figures

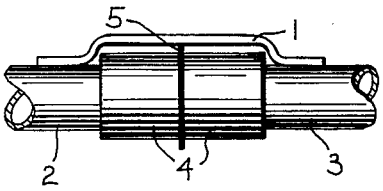
Fig. 1
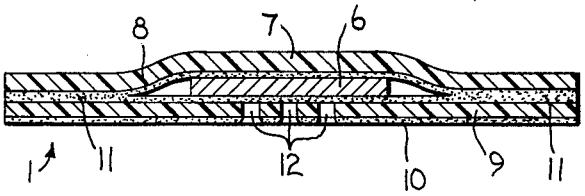
Fig. 4
Fig. 2
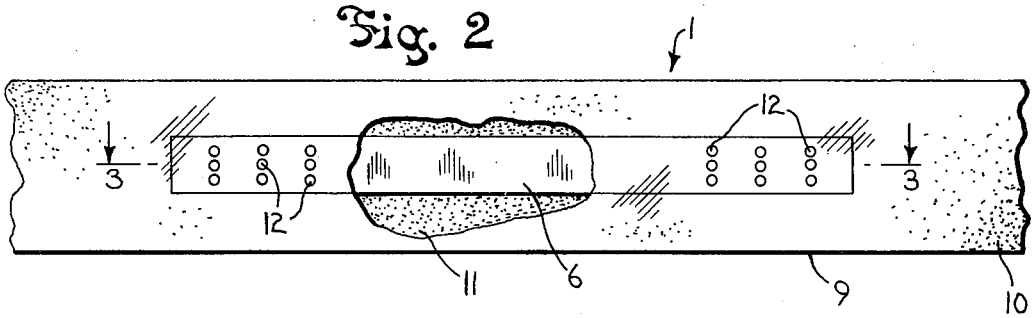
Fig. 3
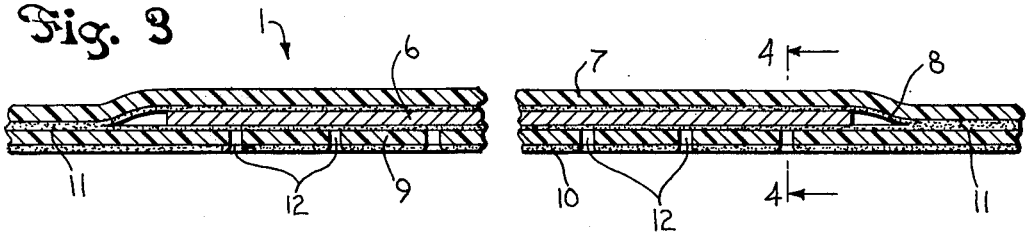
Fig. 5
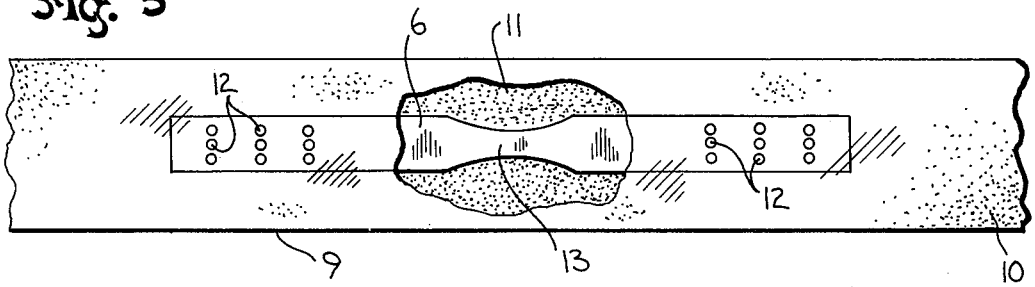
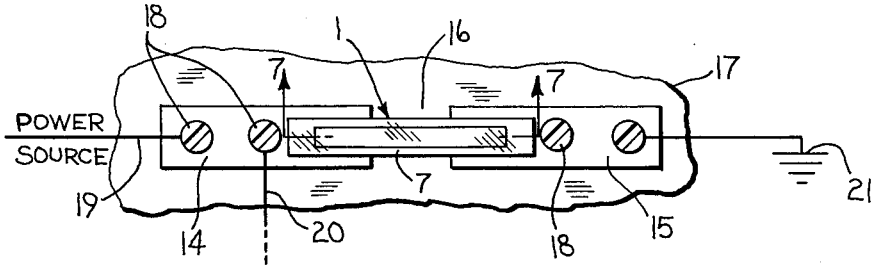
Fig. 6
Fig. 7
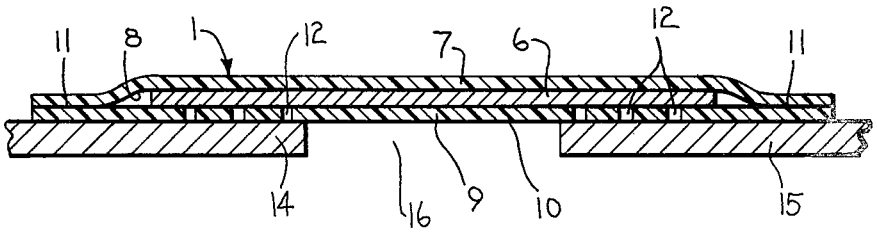

LAMINATED CURRENT SURGE PROTECTOR

BACKGROUND OF THE INVENTION

Various constructions have been employed to provide a current path around insulated fittings or connections used to electrically isolate the ferrous piping of a gas distribution system to handle a current surge through the piping system caused by lighting or a faulty power line from which the current attempts to flow to ground. These current surges cause breakdown of the insulation and injury to the joints between pipes in the piping system. For example, there has been the installation of a spark gap, i.e., conductors from each side of the dielectric terminating in two electrodes with a calculated gap. A pair of electrodes have been used with a specific gap encapsulated in a plastic or metallic chamber filled with an inert gas. In both cases the conductors have to be attached to the metallic parts of the piping by brazing, welding, bolting or the like and the application of these protective devices is unusually time consuming, inconvenient and costly to attach to existing installations.

These problems are solved by an arrestor or current surge protector consisting of a tape which encapsulates a metal conductor and is attached across an insulated joint between pipes or other metal members by the use of a durable adhesive preferably of the pressure sensitive type for ready storage and application to expose the metal conductor through an air gap to the metal members for the passage of current across the joint.

SUMMARY OF THE INVENTION

Problems arise with insulation breakdown at the joints between pipes in gas line supply systems when the system is subjected to high energy impulsing by lightning or stray currents from power line failures seeking to flow to ground.

The arrestor of the invention is directed to a pliable conductor which is encapsulated inside a tape and secured across an insulated joint between metal pipes or other metal members by attaching the arrestor to the respective pipes by a durable, non-flowable adhesive preferably of the pressure sensitive type. The outer layer of the laminated tape is not perforated and is weather resistant and the inner layer of tape is also preferably wear resistant and a high dielectric and is provided with perforations. Both the outer and inner tapes are secured to the metal conductor such as by an adhesive. The perforations in the inner tape in effect provide a gap through which the high energy current can flow through from one pipe or fitting to the encapsulated metal member and thence out the perforations onto the adjacent pipe without attempting to flow across the pipe joint and cause injury to the insulation or the coupling devices which may be used to secure the pipes together at the joint.

The gap is built into each arrestor by varying the thickness of the bottom dielectric layer of tape which establishes the length of the gap formed by perforations or apertures in the bottom or lower tape. Consequently the conductor may by separated from the protected metal pipes or members by a gap of a definite predetermined length. The gap is always an easier path for the current to take when the fitting or pipe is subjected to a high voltage condition. The generally short gap provides less resistance than the inner higher dielectric layer of tape or a path arcing through or around the elements making up the joint.

Under another embodiment of the invention the metal conductor is notched in one portion to a lesser width than other portions of the conductor. A large enough surge of current will normally cause the conductor to fail at the notched area and this is useful for checking the arrestor for failure.

The invention also has application to various forms of electronic equipment such as in the communications and data processing fields. The drawing, by way of example, illustrates how the arrestor might be used in such equipment.

DESCRIPTION OF THE DRAWING

FIG. 1 is a schematic view illustrating the arrestor assembled across the joint between insulated flanges joining two gas pipes together in a piping system;

FIG. 2 is a bottom view of the arrestor of the first embodiment of the invention with parts broken away;

FIG. 3 is a longitudinal section taken on line 3—3 of FIG. 2;

FIG. 4 is a section taken on line 4—4 of FIG. 3;

FIG. 5 is a bottom view of a modified form of the invention with parts broken away;

FIG. 6 is a top plan view of another embodiment of the invention illustrating the arrestor applied to a pair of flat metal plates; and FIG. 7 is a section taken on line 7—7 of FIG. 6 with the non-conducting backing eliminated.

DESCRIPTION OF THE INVENTION

Referring to the drawings there is illustrated an arrestor 1 which has been applied, as illustrated in FIG. 1 across the joint between pipes 2 and 3 which form part of the above ground piping of a gas distribution system. The pipes 2 and 3 are joined by the fittings 4 between which is lodged an insulating medium such as well-known elastomeric components such as, for example, asbestos sheeting, bakelite, hard rubber or a combination of these illustrated by the electrically insulating gasket 5.

Arrestor 1 is of a laminated construction and is constructed of components which are flexible, and formable so that it can be readily applied over irregularly contoured fittings 4 or the like as is illustrated in FIG. 1.

In the generally central part of arrestor 1 is located a metal conductor 6 illustrated in strip form although it could have other shapes. The conductor 6 is of a pliable, corrosion resistant metal which has a low resistance, and examples of suitable metals are aluminum, copper, stainless steel or any others which would allow the passage of electric current without undue resistance.

The outer surface of conductor 6 is covered by a weather resistant coating such as a strip of tape-like material 7 which is abrasion resistant and capable of withstanding the elements, atmospheric corrosion and temperature changes. The tape 7 is not perforated and is adhered to the outer surface 5 of conductor 6 by a bonding agent such as adhesive 8 which is waterproof, non-flowable and durable. A workable range of thickness for tape 7 has been found to be 2 and 5 mils. If the coating is a tape, tapes made of polyester, vinyl, metalized mylar, teflon or a polyethylene may be successfully employed.

The tape-like material 9 is adhered to the inner surface of conductor 6 by a bonding agent such as the adhesive 10 which is waterproof, non-flowable and durable and preferably pressure sensitive.

The tapes 7 and 9 extend beyond the ends and both sides of metal conductor 6 as illustrated in FIGS. 2-4 and is adhered together at the ends and sides by adhesive 11 so that metal conductor 6 is completely encapsulated within the tapes 7 and 9. The length of arrestor 1 may be varied to extend across different length joints and different sizes of fittings used in the joints and likewise the width may vary to the extent that a substantial extent of the inner portion of the tape will provide sufficient surface for adherence to the metal surfaces to which arrestor 1 is applied.

The adhesive 10 and the tape 9 have a plurality of aligned apertures 12 extending through them to expose metal conductor 6 to the metal pipes 2 and 3 when arrestor 1 is adhered to pipes 2 and 3 as illustrated in FIG. 1. The apertures 12 may extend throughout the length of tape 9 but preferably are located at opposite end portions of arrestor 1 so that there will be apertures 12 exposed to pipes 2 and 3.

The apertures 12 form a gap for passage of an excessive surge of current which may be developed in the piping system by lightning or a power line failure or the like can flow to conductor 6 as from pipe 2 and thereby across the joint between the pipes and be discharged to pipe 3. By this flow of current the insulating medium 5 and the pipes 2 and 3 at the joint area will not be destroyed or injured by a surge of current which the joint cannot handle.

The gap by use of apertures 12 is built into arrestor 1 by varying the thickness of the inner dielectric layer of tape 9 because the longer the gap the greater the resistance. A 5 mil gap in arrestor 1 starts to pass current between 600 to 1000 volts and a spark is produced. Fittings 4 will resist 2500 volts or more and arrestor 1 is designed so that it always has a lower resistance than the joint or insulating medium it is protecting.

The bottom view of FIG. 5 illustrates arrestor 1 in which conductor 6 is notched or inwardly tapered on both sides so as to provide the narrowed portion 13 in the conductor. If the surge may be too large for conductor 6 to handle then it will fail at narrowed portion 13. The notched construction therefore makes is possible to readily check conductor 6 for failure as the narrowed portion is broken similar to an electric fuse.

The invention not only finds application in protecting gas supply pipes where it is necessary to protect the integrity of the joint and its components and to prevent perforation of the pipe and thus avoid possible gas leakage or ignition but also other types of piping systems as well as electronic equipment in the fields of communications and data processing equipment. In these latter usages arrestor 1 can be readily adhered to wires disposed in a spaced in line position between a source of current and ground or secured to plates assembled in an in line position. The embodiment of the invention shown in FIGS. 6 and 7 illustrates the manner in which arrestor 1 may be employed such as in a television set, and arrestor 1 may be applied to any type of communication equipment which would be required to be protected from a current surge.

In these figures there is shown plate 14 located in line with plate 15 with the air space or air insulating medium 16 disposed between the plates. Each plate 14 and 15 is secured to the non-conducting backing member 17 by the screws 18.

Plate 14 is connected to a power source, not shown, by the power line 19 and current coming into the set normally passes through plate 14 and then is conducted into the operating units of the set, not shown, by the line 20. Plate 15 is connected to ground 21.

In the event there may be a surge of current into plate 14 through power line 19 which is of a voltage that would be injurious to the television set the current then by-passes line 20 and then flows through arrestor 1 and thence to plate 15 and is discharged to ground 21.

The invention may be applied across the joint of any type or construction of metal members which are required to be protected from a surge of current.

Various modes of carrying out the invention are contemplated as being within the scope of the following claims particularly pointing out and distinctly claiming the subject matter which is regarded as the invention.

I claim:

1. A laminated current surge protector to protect metal members separated at a joint therebetween by an insulating medium, which comprises a flexible, conformable arrestor extending across the joint and adhered to the outer surfaces of the respective metal members, said arrestor having a metal conductor, a weather resistant coating adhered to the outer surface of the conductor, a durable tape adhered to the inner surface of the conductor and said coating and tape being disposed to encapsulate the metal conductor, and a plurality of perforations disposed in the durable tape exposed to each of the respective metal members to provide a gap through which excessive surges of current flowing through the metal members can pass through the metal conductor from one member to the other and thereby prevent flow of current through the joint and injury to the latter.

2. The laminated surge protector of claim 1 and the metal conductor being a strip of pliable aluminum, and the adherence of the bottom of the conductor to the metal members being a layer of non-flowable adhesive and of the pressure sensitive type.

3. The laminated surge protector of claim 1, and the coating being a strip of tape and a durable non-flowing adhesive adhering the tape to the conductor.

4. The laminated surge protector of claim 1, and the metal members to be protected being a pair of metal pipes joined end to end, and the insulating medium being dielectric components insulating the free ends of the pipes from each other.

5. The laminated surge protector of claim 1, and the metal members to be protected being a pair of flat members, and the insulating medium being air.

6. The laminated surge protector of claim 1 and the metal conductor being provided with a narrowed cross-section portion to more readily ascertain failure of the conductor at such narrowed portion.

* * * * *